US006253850B1

(12) United States Patent
Nazzai et al.

(10) Patent No.: US 6,253,850 B1
(45) Date of Patent: Jul. 3, 2001

(54) SELECTIVE ZONAL ISOLATION WITHIN A SLOTTED LINER

(75) Inventors: Gregory Richard Nazzai, Kingwood; Timothy John Frank, Houston; Robert Joe Coon, Missouri City, all of TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/510,895

(22) Filed: Feb. 23, 2000

Related U.S. Application Data

(60) Provisional application No. 60/121,452, filed on Feb. 24, 1999.

(51) Int. Cl.[7] ..... E21B 29/08; E21B 43/10

(52) U.S. Cl. ..... 166/277; 166/207; 166/212; 166/387

(58) Field of Search ..... 166/206, 207, 166/212, 216, 217, 242.1, 242.2, 277, 285, 286, 287, 384, 385

(56) References Cited

U.S. PATENT DOCUMENTS

| | | | | |
|---|---|---|---|---|
| 3,191,677 | * | 6/1965 | Kinley | 166/277 |
| 3,326,293 | * | 6/1967 | Skipper | 166/277 X |
| 3,918,520 | | 11/1975 | Hutchison | 166/64 |
| 4,865,127 | | 9/1989 | Koster | 166/277 |
| 4,872,509 | | 10/1989 | Dickinson et al. | 166/278 |
| 5,040,283 | * | 8/1991 | Pelgrom | 166/277 X |
| 5,219,028 | * | 6/1993 | Martin et al. | 166/242.1 X |
| 5,358,054 | * | 10/1994 | Bert | 166/387 X |
| 5,366,012 | * | 11/1994 | Lohbeck | 166/277 |
| 5,454,419 | * | 10/1995 | Vloedman | 166/277 |
| 5,494,106 | * | 2/1996 | Gueguen et al. | 166/277 |
| 5,613,557 | * | 3/1997 | Blount et al. | 166/277 |
| 5,667,011 | * | 9/1997 | Gill et al. | 166/207 X |
| 5,964,288 | * | 10/1999 | Leighton et al. | 166/207 |

* cited by examiner

*Primary Examiner*—George Suchfield

(57) ABSTRACT

Selective isolation of a zone within a slotted liner completion of a wellbore is accomplished by expanding the original slotted liner to the full inner diameter of the wellbore into the annular area normally found around slotted liners. At least one solid tubular is run into the expanded area of the slotted liner and expanded at least in that section of the wellbore to be isolated. A custom expandable slotted liner can be run and expanded within the existing expanded slotted liner if excessive splits or rips should occur in the existing slotted liner due to expansion. Epoxies, rubber, or other sealing materials can also be utilized to better effect a seal between the liners.

13 Claims, 4 Drawing Sheets

SELECTIVE ZONAL ISOLATION WITHIN A SLOTTED LINER

This Applications claims the benefit of Provisional No. 60/121,452 filed Feb. 24, 1999.

BACKGROUND OF THE INVENTION

1. The Field of the Invention

The present invention relates to a method to provide isolation within a zone of a wellbore lined with a slotted liner by placing an expandable liner within the zone to be isolated.

2. The Prior Art

There is a great deal of prior art relating to isolating portions of a wellbore for various reason. For example, a zone may be producing water or gas and needs to be shut off for more effective production of the petroleum being recovered. Also, a zone may be producing sand or collapsing and creating debris and needs to be isolated to maintain and efficient operation. However, different problems arise when the wellbore has been completed with the insertion of a known slotted liner.

One example of the prior art is U.S. Pat. No. 5,366,012 which describes a method of completing uncased sections of a wellbore by placing, at a predetermined position in the wellbore, a liner which is provided with a plurality of overlapping slots. The upper end of the liner is fixed in place and an upwardly tapering expansion mandrel is drawn upwardly through the slotted liner expanding it outwardly to engage the walls of the wellbore. This circumferentially outward movement is facilitated by the opening of the slots, together with a slight shortening of the overall length of the liner. Slotted liner completions of this type leave an annular area around the slotted liner which makes zonal selectivity nearly impossible.

Another suitable method for sealing between a lining and wellbore, casing or pipeline is shown in U.S. Pat. No. 5,494,106. This patent describes a deformable annular seal which is lowered into the wellbore in a deformed or contracted state, which does not impede insertion. Once in place the seal is expanded. During expansion of the seal it is hardened to form a substantially permanent repair.

Another method for lining a casing is shown in U.S. Pat. No. 5,454,419 in which a tubular polymeric material is lowered into the wellbore in a stretched condition, due to a series of weights attached to the leading or bottom end. When properly positioned, the weights are released and the tubular material returns to its normal condition in which it presses against the walls to the wellbore.

SUMMARY OF THE INVENTION

The selective zonal isolation system of the present invention can be utilized within a slotted liner completion to selectively isolate, either permanently or temporarily, sections of the wellbore for such applications as fluid shutoff or stimulation purposes. The subject selective zonal isolation system works by first expanding an existing slotted liner in the wellbore to the full inner diameter of the hole. Then one or more solid tubular members are run into the expanded area and are expanded at least in that section of the wellbore to be isolated. It is also possible to use expandable packers to selectively isolate the section. Additionally, if excessive splits or rips should occur in the existing slotted liner, after expansion, a custom second expandable slotted liner can be run into the wellbore and expanded within the original expanded slotted liner. Epoxies, rubber, or other sealing materials can also be utilized to better effect a seal. The same methodology could also be utilized in solid uncemented pipe sections to increase the effective wellbore radius. Benefits are sealing or zonal isolation of existing slotted liner, perforated pipe, sand control device or open hole or other completion system.

BRIEF DESCRIPTION OF THE DRAWINGS

The present invention will now be described, by way of example, with reference to the accompanying drawings in which.

DETAILED DESCRIPTION OF A PREFERRED EMBODIMENT

Figure 1:
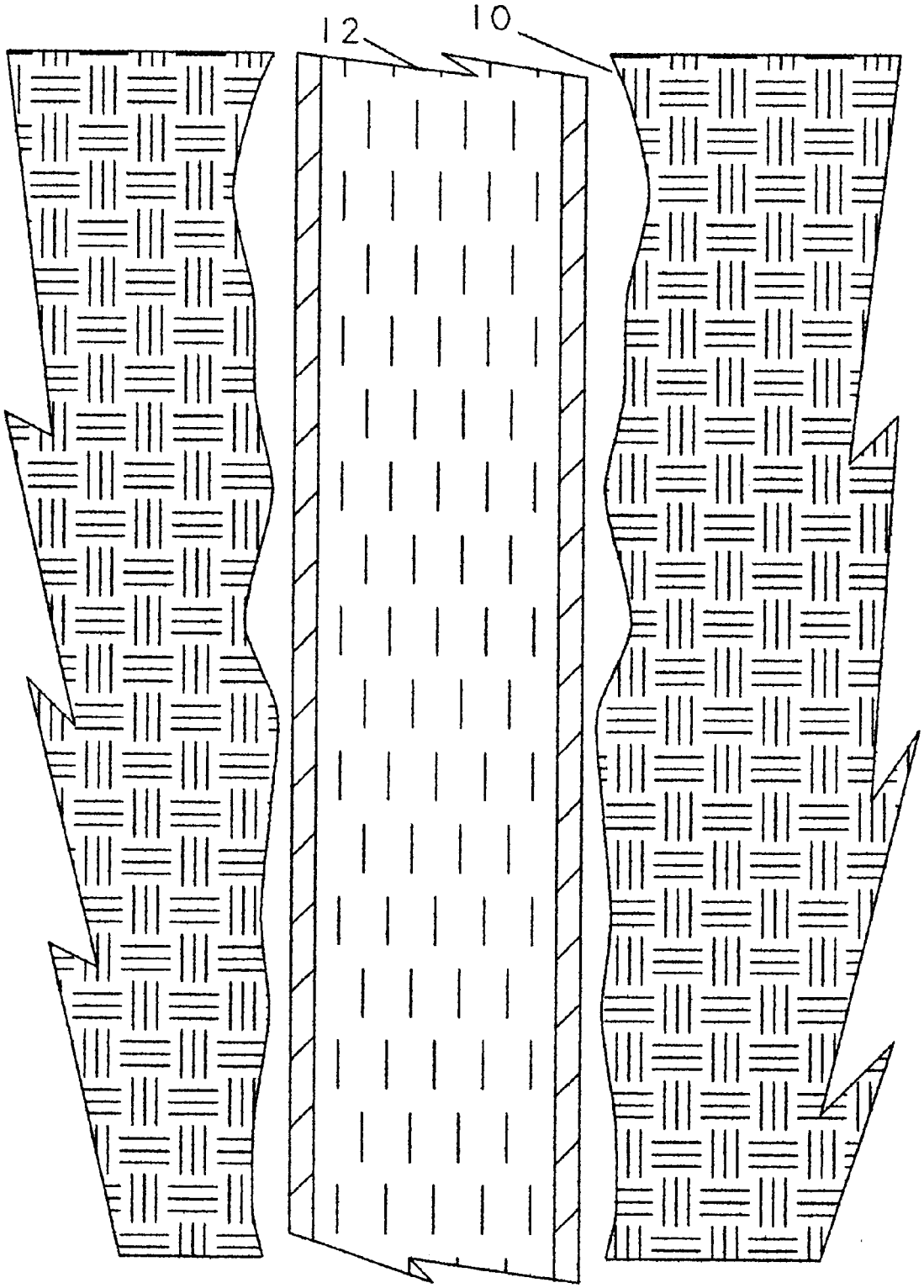
FIG. 1 is a vertical section through a portion of a wellbore with an expandable liner in place.
Figure 2:
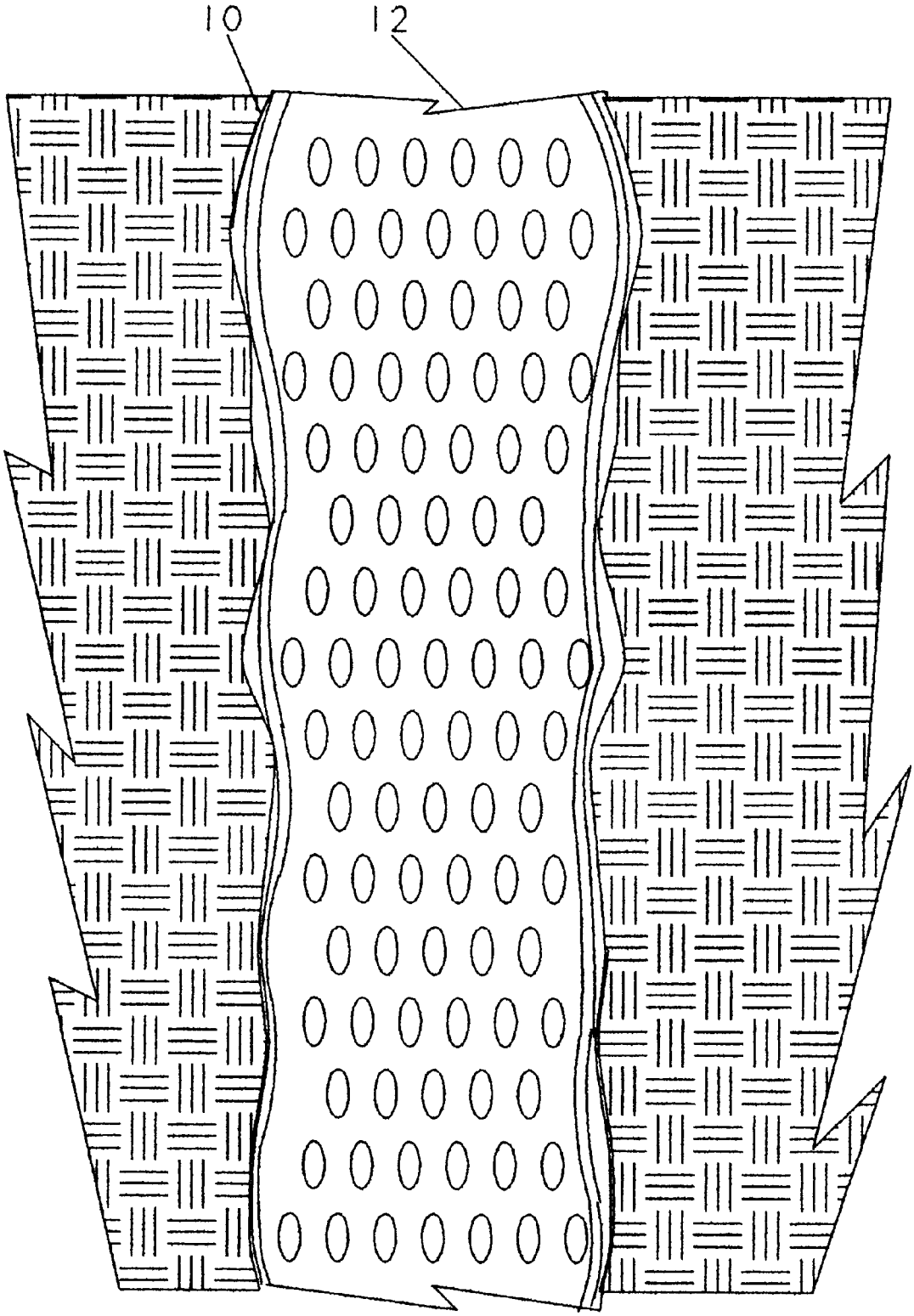
FIG. 2 is a vertical section similar to FIG. 1 showing the wellbore after expansion of the liner.
Figure 3:
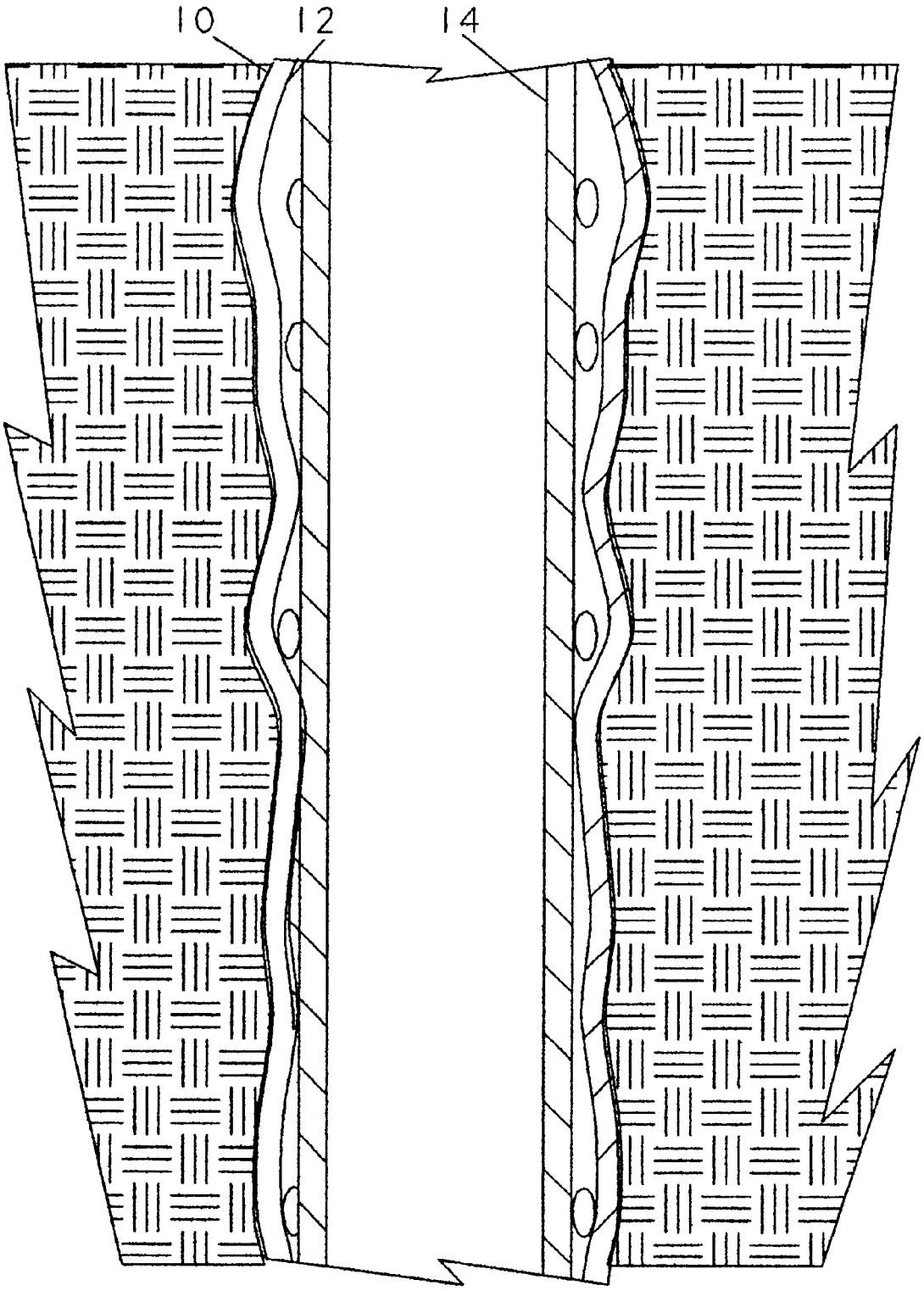
FIG. 3 is a vertical section of the same well with the secondary liner in position.
Figure 4:
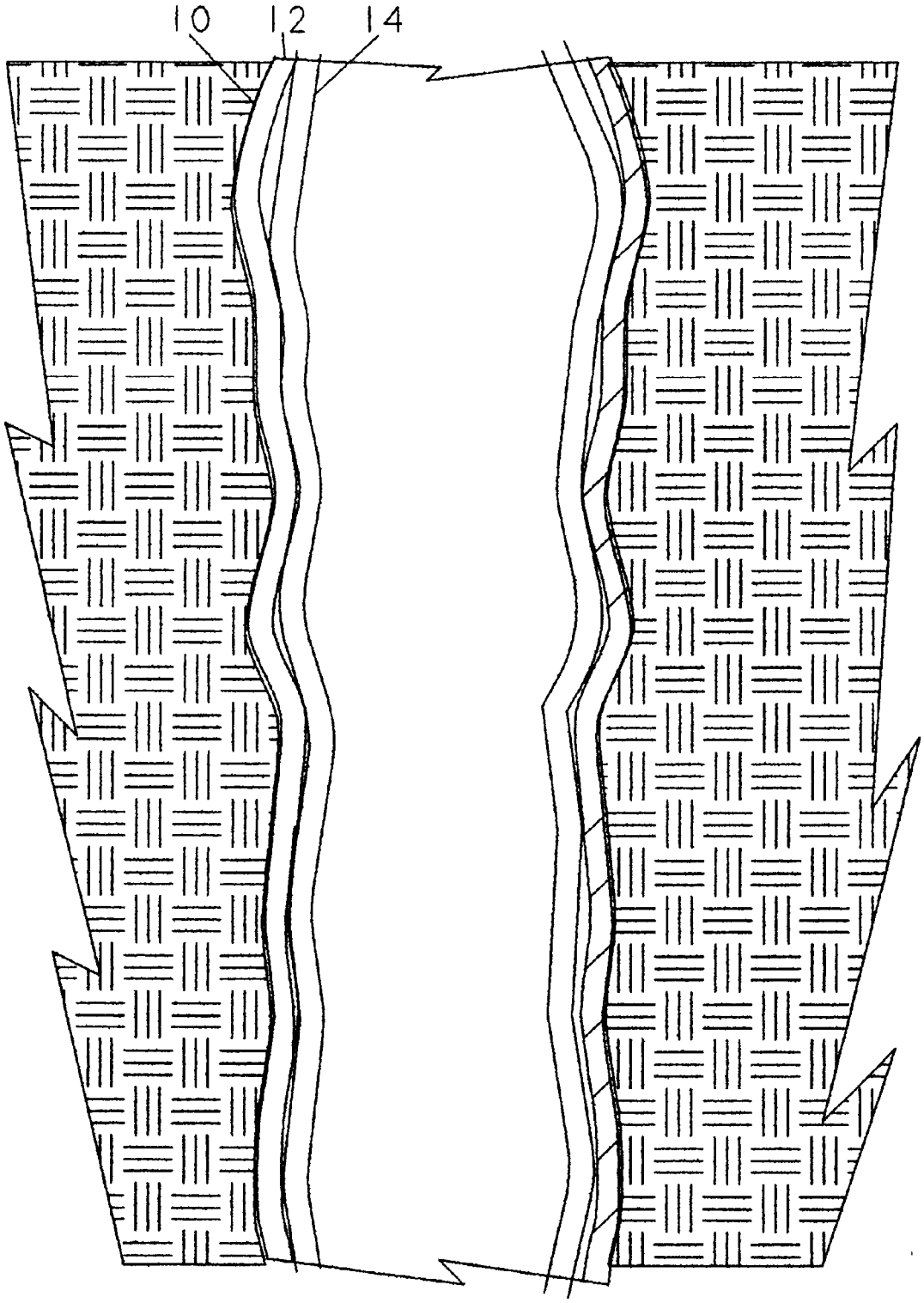
FIG. 4. Is a vertical section through the well of FIG. 3 with the sealing liner in place.

The wellbore 10 (FIGS. 1 and 2) has a first expandable liner 12 in place and running through a zone of the wellbore to be isolated. Generally this first liner, when expanded, does not fully contact all surfaces of the wellbore and it can contain a number of tares and/or rents in the slots. A second liner 14 (FIGS. 3 and 4) is inserted into the wellbore and positioned to cover at least the zone of the wellbore 10 to be isolated. Then the second liner 14 is expanded to sealing engage the first expanded slotted liner 12 sealing the openings therein to isolate that portion of the wellbore. This sealing can be improved by the addition of sealing materials (not shown), such as epoxies, rubber and the like.

While only a single second liner 14 has been shown, it is within the scope of the present invention to include insertion of more than one second liner. It is also within the scope of the invention that these second liners have physical characteristics different from one another so that, for example, a first liner would have characteristics suitable for withstanding high pressures while the next liner would have characteristics suitable for withstanding erosive effects of the flow through the wellbore.

It should be noted when any slotted liner is expanded, many things can happen to it since wellbores are never smooth cylinders. For example, while it is hoped that the majority of the slots will open as expected allowing the slotted liner to expand, the wellbore walls are never uniform and expansion will be at various rates in different directions and for different distances. This variation in expansion can stress the slotted liner producing tares, rents and other openings which, while not adversely affecting the task of the slotted liner, can result in problems for subsequently sealing portions of the wellbore protected by such a slotted liner.

The selective zonal isolation system of the present invention can be utilized within a slotted liner completion to selectively isolate, either permanently or temporarily, sections of the wellbore for such applications as fluid shutoff or stimulation purposes. Current slotted liner completions leave an annular area around the slotted liner which makes zonal selectivity nearly impossible. The selective zonal isolation system according to the present invention works by first expanding the current slotted liner to the full inner diameter of the wellbore, running at least one solid tubular liner into the expanded area and expanding at least that section of the tubular liner in the area to be isolated. Additionally, if excessive splits or rips should occur in the existing slotted liner after expansion, a custom expandable slotted liner (not shown) can be run into the wellbore and expanded within the existing expanded slotted liner. Epoxies, rubber, or other sealing materials (also not shown) can also be utilized to better effect a seal between the expanded slotted liner and the tubular liner.

The same methodology of the present invention could also be utilized in solid uncemented pipe sections to increase the effective wellbore radius.

While a metal tubular liner has been shown in the drawings, the liner is not so limited. The tubular liner could be made from a wide variety of metals and plastics materials. For example, a memory metal could be used. The tubular liner would be formed on the surface, deformed for insertion into the wellbore, and reformed when in position. Likewise, the tubular liner could be formed and folded or compressed and later expanded or reformed when it position by use of a mechanical device such as a mandrel or an inflatable member, or by a hydropneumatic force, including an explosive force.

Benefits of the present invention include sealing or zonal isolation of existing slotted liner, perforated pipe, sand control device or open hole or other completion system.

The present invention may be subject to many modifications and changes which would occur to one skilled in the art. Thus the described embodiment should be considered in all respects as illustrative and not restrictive of the scope of the subject invention as defined by the accompanying claims.

We claim:

1. A method to provide selective isolation within a zone of a well lined with an expanded slotted liner, comprising the steps of:

fully expanding an expandable slotted liner within the wellbore to contact substantially the entire surface of the wellbore adjacent said liner;

placing at least one additional expandable substantially imperforate liner within a zone of the original expanded liner to be isolated; and expanding said at least one additional expandable liner into sealing contact with the original expanded slotted liner at least adjacent the ends of the zone to be isolated whereby the desired zone of the wellbore is isolated from a formation.

2. The method according to claim 1 wherein said sealing is permanent.

3. The method according to claim 1 wherein said at least one additional expandable liner is inserted in a compressed condition and released when in position.

4. The method according to claim 1 wherein said at least one additional expandable liner is inserted in a collapsed condition and expanded when in position.

5. The method according to claim 1 wherein said at least one additional expandable liner is formed of a memory retentive material which is initially formed, then deformed to allow insertion into the wellbore, and its memory activated to expand the liner to its original shape and seal the selected zone of the wellbore.

6. The method according to claim 1 wherein said at least one expandable liner is metal.

7. The method according to claim 1 wherein said at least one expandable liner is formed from a plastics material.

8. The method according to claim 1 wherein each said expandable liner has different physical characteristics from a preceding liner whereby different characteristics of flow through the wellbore, such as pressure and erosion, can be addressed.

9. The method according to claim 1 wherein said expansion is accomplished by use of a mandrel.

10. The method according to claim 1 wherein said expansion is accomplished by an explosive force.

11. The method according to claim 1 wherein said expansion is accomplished by pressurized fluid.

12. The method according to claim 1 further comprising the step of:

applying sealing materials to effect a better seal between said slotted liner and said at least one expandable liner.

13. A selective zonal isolation method which can be utilized to selectively isolate, either permanently or temporarily, sections of a wellbore within a slotted liner completion for such applications as fluid shutoff or stimulation purposes, comprising:

expanding the slotted liner to substantially that of the inner diameter of the wellbore;

running at least one expandable imperforate liner into the zone to be isolated; and expanding said at least one imperforate liner to sealingly engage said slotted liner at least adjacent the ends of said zone to be isolated.

* * * * *

UNITED STATES PATENT AND TRADEMARK OFFICE

CERTIFICATE OF CORRECTION

PATENT NO. : 6,253,850 B1 
DATED : July 3, 2001
INVENTOR(S) : Gregory Richard Nazzal, Timothy John Frank and Robert Joe Coon It is certified that error appears in the above-identified patent and that said Letters Patent is hereby corrected as shown below:

Title page,
Item [75], Inventor's name "Gregory Richard Nazzai" should be -- Gregory Richard Nazzal --.

Signed and Sealed this

Twenty-fifth Day of February, 2003

JAMES E. ROGAN
*Director of the United States Patent and Trademark Office*